US011084244B2

(12) United States Patent
Maslana et al.

(10) Patent No.: US 11,084,244 B2
(45) Date of Patent: Aug. 10, 2021

(54) SYSTEMS AND METHODS OF FOOD PACKAGING CLOSURE

(71) Applicant: Prince Castle LLC, Carol Stream, IL (US)

(72) Inventors: Eugene S. Maslana, Arlington Heights, IL (US); Sean Forrest, Park Ridge, IL (US); Brian Smetana, Downers Grove, IL (US); Richard Bauer, Palatine, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 168 days.

(21) Appl. No.: 16/277,061

(22) Filed: Feb. 15, 2019

(65) Prior Publication Data

US 2019/0248097 A1 Aug. 15, 2019

Related U.S. Application Data

(60) Provisional application No. 62/631,160, filed on Feb. 15, 2018.

(51) Int. Cl.
*B31F 5/02* (2006.01)
*B26D 1/00* (2006.01)

(52) U.S. Cl.
CPC ..... *B31F 5/027* (2013.01); *B26D 1/0006* (2013.01); *B26D 2001/006* (2013.01)

(58) Field of Classification Search
CPC ... B31F 5/027; B31F 5/02; B42B 5/00; B42B 5/08; B42F 3/00; B42F 3/003; B65B 51/144; B26D 1/0006; B26D 2001/006
USPC ..... 493/350, 351, 390, 391
See application file for complete search history.

(56) References Cited

U.S. PATENT DOCUMENTS 1,009,644 A * 11/1911 Bump ..... B31F 5/027 493/351
1,055,680 A * 3/1913 Stacy et al. ..... B31D 1/023 493/351
1,130,589 A * 3/1915 Gage ..... B31D 1/023 493/351
1,130,595 A * 3/1915 Hawkins ..... B31F 5/027 493/351
1,148,672 A * 8/1915 Gessler ..... B31D 1/023 493/351
1,229,213 A * 6/1917 Bernard ..... B31D 1/023 493/351

(Continued)

FOREIGN PATENT DOCUMENTS

WO 2011/052150 A1 5/2011
WO 2011/093016 A1 8/2011

*Primary Examiner* — Dariush Seif
(74) *Attorney, Agent, or Firm* — Andrus Intellectual Property Law, LLP

(57) ABSTRACT

A tamper-evident food delivery packaging systems, methods of tamper-evident packaging of food for delivery, and apparatus for tamper-evident food packaging operate to form resilient self-fastening perforations through a packaging. A binding apparatus includes an anvil and a flipper plate. A cutter head includes a profile blade and a slot blade. A pusher is pivotably connected between the profile blade and the slot blade. The cutting apparatus moves in a reciprocal motion relative to the anvil while the flipper plate engages a pusher to pivot the pusher during the reciprocal motion.

20 Claims, 10 Drawing Sheets

(56) References Cited

U.S. PATENT DOCUMENTS 1,324,103 A * 12/1919 Cone ..... B31F 5/027 493/351
1,490,437 A * 4/1924 Sparks ..... B31F 5/027 493/351
3,577,575 A * 5/1971 Taniguchi ..... B31F 5/027 7/158
3,714,688 A * 2/1973 Olson ..... B21D 39/034 29/21.1
4,616,774 A 10/1986 Yasuda
5,024,643 A * 6/1991 Kastner ..... B31F 5/027 493/351
5,447,402 A * 9/1995 Kobayashi ..... B31F 5/027 412/33
5,899,841 A * 5/1999 Berger ..... B31F 5/027 493/351
8,075,236 B2 * 12/2011 Penne ..... B26F 1/22 412/6
8,297,610 B2 * 10/2012 Shiraishi ..... B42B 4/00 270/58.09
8,444,133 B2 * 5/2013 Kimura ..... B65H 31/24 270/58.08
8,662,488 B2 * 3/2014 Awano ..... B65H 31/36 270/58.08
D704,017 S 5/2014 Matsushita et al.
9,475,332 B2 * 10/2016 Aoi ..... B42F 3/003
10,245,873 B2 * 4/2019 Kenjo ..... B65H 37/04
2011/0233844 A1 * 9/2011 Shiraishi ..... B42B 5/00 270/58.11
2012/0213612 A1 * 8/2012 Wu ..... B26F 1/36 412/16
2012/0301250 A1 * 11/2012 Wu ..... B42D 1/004 412/16
2013/0190156 A1 * 7/2013 Matsukawa ..... B42F 3/003 493/351
2014/0161564 A1 * 6/2014 Aoi ..... B26F 1/22 412/16
2020/0101678 A1 * 4/2020 Keikhaee ..... B29C 65/7802

* cited by examiner

SYSTEMS AND METHODS OF FOOD PACKAGING CLOSURE

CROSS-REFERENCE TO RELATED APPLICATIONS

The present application claims priority of U.S. Provisional Patent Application No. 62/631,160, filed on Feb. 15, 2018, the contents of which is hereby incorporated by reference in its entirety.

BACKGROUND

The present disclosure relates to the field of restaurant food preparation. More specifically, the present disclosure relates to systems and methods for packaging and closing packages of food prepared as an order for customer pickup or delivery.

Once an order that includes a variety of food items is assembled, it is desirable for a restaurant to package that food order, for example in a bag or a box to ensure that the order stays together. It is further desirable for a restaurant to have manners that ensure that the assembled order contents stays within the package and is not inadvertently removed prior to delivery to the customer.

This need is further applicable to food delivery as it is desirable that each customer order stay assembled despite the transport of the order multiple times, for example from the restaurant to a delivery vehicle, movement of the order within the delivery vehicle, and carrying the order from the delivery vehicle to the house or other location of the customer. In this delivery system, it is partly the responsibility of the delivery worker to ensure that the order is transported and delivered in a manner that keeps the order intact to ensure that the customer receives the full order of food items. In a food delivery system wherein the delivery person is an employee of the restaurant, the employee's duty and responsibility to the restaurant and the employer and the customer of said employer helps to create a system wherein consumers have increased trust in the delivery. However, with the increase in third-party delivery services, there is no longer an employee-employer relationship for the restaurant to ensure that the order of food arrives at the customer in the completeness as packaged by the restaurant and in an unadulterated state.

Various apparatus are available for mechanically securing materials together. U.S. Pat. No. 4,616,774 discloses a stapler that sequentially pushes staples constructed of steel or other material, frequently metal, through the materials to be secured. U.S. Pat. No. 3,577,575, entitled "Binding and Opening Device" is incorporated by reference herein in its entirety and discloses a device that makes a U-shaped slot in paper and bends the U-shaped slot through an I-shaped slot to bind the papers together. U.S. Pat. No. 5,899,841, entitled "Device for Mechanically Binding Documents" is incorporated by reference herein in its entirety and discloses the mechanical connection of documents by the cutting of tongues from the documents and the insertion of those tongues into eyes cut in the documents. U.S. Patent Application Publication No. 2013/0190156 entitled "Fastening Tool" is incorporated by reference herein in its entirety and discloses a handle member that is formed into a pressing portion to move an upper surface downwards through sheets of paper to be fastened.

With the proliferation of third-party delivery services, which may or may not operate with the consent and cooperation of food preparation providers, the food providers have increased needs for systems and methods for order packaging and closure that provide a tamper-evident closure of a package of a food order. Such solutions are therefore desirable in the field of restaurant services.

BRIEF DISCLOSURE

An exemplary embodiment of a tamper-evident food delivery packaging system operates to cut a resistant self-fastening perforation through ends of peripheral walls to resiliently close the opening of a packaging. A packaging is configured to receive a food order therein. The packaging includes an open interior defined at least in part by a peripheral wall and a bottom end of the packaging. The packaging includes an opening at an open end opposite the closed end. Ends of the peripheral wall about the opening are movable such as to bring the ends of the peripheral wall together to close the open interior of the packaging. A tamper-evident binding apparatus includes an anvil. A profile blade has an elongated and concave perimeter. A slot blade has a shallow and concave perimeter. The profile blade and the slot blade are rigidly secured to a blade mount to form a cutter head. The concave perimeter of the profile blade opens towards the concave perimeter of the slot blade. A pusher is pivotably connected to the blade mount at a position intermediate the profile blade and the slot blade, and configured to pivot about a pivot point. A flipper plate is disposed intermediate the cutter head and the anvil. The flipper plate includes an opening and a flipper bar extending across the opening. The cutter head is movable in a reciprocal motion relative to the anvil. In the reciprocal motion, at least a portion of the cutter head extends through the opening through the flipper plate and the flipper bar engages the pusher to pivot the pusher about the pivot point. When the packaging is positioned between the anvil and the flipper plate, the reciprocal motion of the cutter head cuts a resistant self-fastening perforation through the ends of the peripheral walls to resiliently close the opening of the packaging.

In additional embodiments of the system, the profile blade operates to cut a tongue from the peripheral walls and the slot blade operates to cut a slot through the peripheral walls. Pivoting of the pusher about the pivot point engages the tongue and moves the tongue relative to the slot to form the resistant self-fastening perforation. The profile blade operates to cut a tongue from the peripheral walls and the slot blade operates to cut a slot through the peripheral walls. Pivoting of the pusher about the pivot point engages the tongue and moves the tongue relative to the slot to form the resistant self-fastening perforation. The slot blade includes an aperture defined through the slot blade. A finger of the pusher extends through the aperture of the slot blade when the pusher pivots about the pivot point. The finger pushes the tongue through the aperture. Upon retraction of the cutter head in the reciprocal motion, a top edge of the aperture engages the tongue and pulls the tongue through the slot to form the resistant self-fastening perforation.

Embodiments of the system may include a motor connected to a drive shaft. The motor operates to rotate the drive shaft to cause the reciprocal motion of the cutter head. An eccentric may be secured to the drive shaft, wherein the eccentric engages a cutting assembly comprising the cutter head to transfer rotational movement of the drive shaft to the reciprocal movement of the cutter head. The cutting assembly may further include a piston block. The cutter head may be secured to the piston block. The piston block may further include an opening through it, the opening defined by a contact surface. The eccentric may engage the contact surface of the piston block to transfer rotation of the drive shaft to reciprocal motion of the cutting assembly.

Additional embodiments may include an anvil arm may include the anvil. The anvil arm defines an open interior configured to receive at least a portion of the profile blade and the slot blade. The anvil may include an opening with a perimeter that follows a perimeter of the profile blade and the slot blade.

An exemplary embodiment of a temporary tamper-evident binding apparatus includes an anvil. A profile blade has an elongated and concave perimeter. A slot blade has a shallow and concave perimeter. The profile blade and the slot blade are rigidly secured to a blade mount to form a cutter head. The concave perimeter of the profile blade opens towards the concave perimeter of the slot blade. A pusher is pivotably connected to the blade mount at a position intermediate the profile blade and the slot blade, and configured to pivot about a pivot point. A flipper plate is disposed intermediate the cutter head and the anvil. The flipper plate includes an opening and a flipper bar extending across the opening. The cutter head is movable in a reciprocal motion relative to the anvil. In the reciprocal motion at least a portion of the cutter head extends through the opening through the flipper plate and the flipper bar engages the pusher to pivot the pusher about the pivot point.

In further exemplary embodiments of the temporary tamper-evident binding apparatus the slot blade includes an aperture defined through the slot blade. A finger of the pusher extends through the aperture of the slot blade when the pusher pivots about the pivot point. The anvil may include an opening with a perimeter that follows a perimeter of the profile blade and the slot blade. An anvil arm may include the anvil and the anvil arm defines an open interior configured to receive at least a portion of the profile blade and the slot blade. The opening through the flipper plate may have a perimeter that follows the perimeter of the profile blade and the slot blade.

Exemplary embodiments of the temporary tamper-evident binding apparatus may include a motor connected to a drive shaft. Operation of the motor rotates the drive shaft to cause the reciprocal motion of the cutter head. An eccentric may be secured to the drive shaft. The eccentric engages a cutting assembly comprising the cutter head to transfer rotational movement of the drive shaft to the reciprocal movement of the cutter head. The cutting assembly may further include a piston block. The cutter head may be secured to the piston block. The piston block may further include an opening through it, the opening being defined by a contact surface. The eccentric engages the contact surface of the piston block to transfer rotation of the drive shaft to reciprocal motion of the cutting assembly. The piston block may include an elongated dimension and a set of glide bars and glide rails engage to guide translation of the cutting assembly in the reciprocal motion.

Exemplary embodiments of a method of providing food in tamper-evident packaging may include providing a packaging configured to receive a food order therein. The packaging includes an open interior defined at least in part by a peripheral wall and a bottom end of the packaging. The packaging comprising an opening at an open end opposite the closed end wherein ends of the peripheral wall about the opening are movable such as to bring the ends of the peripheral wall together to close the open interior of the packaging. The peripheral walls of the packaging are positioned within a slot between a flipper plate and an anvil of a tamper-evident binding apparatus. The tamper-evident binding apparatus includes a profile blade having an elongated and concave perimeter and a slot blade having a shallow and concave perimeter. The profile blade and the slot blade are rigidly secured to a blade mount to form a cutter head. The concave perimeter of the profile blade opens towards the concave perimeter of the slot blade. A pusher is pivotably connected to the blade mount at a position intermediate the profile blade and the slot blade. The pusher is configured to rotate about a pivot point. The flipper plate includes an opening and a flipper bar extending across the opening. The cutter head is movable in a reciprocal motion relative to the anvil. In the reciprocal motion at least a portion of the cutter head extends through the opening through the flipper plate and the flipper bar engages the pusher to pivot the pusher about the pivot point. The cutter head moves in a reciprocal motion relative to the peripheral walls. A tongue is cut from the peripheral walls with the profile blade. A slot is cut through the peripheral walls with the slot blade. The pusher is rotated about the pivot point to engage the tongue and move the tongue relative to the slot to form the resistant self-fastening perforation.

In exemplary embodiments of the method, the slot blade includes an aperture defined through the slot blade. The method may further include pushing the tongue through the aperture with a finger of the pusher as the pusher rotates about the pivot point. Upon retracting the cutter head in the reciprocal motion, the tongue is engaged with a top edge of the aperture to pull the tongue through the slot to form the resistant self-fastening perforation. The binding apparatus may further include a motor connected to a drive shaft to which an eccentric is secured and the cutter head is secured to a piston block. The piston block includes an opening defined by a contact surface. The method may further include rotating the eccentric with the motor and drive shaft and engaging the contact surface with the eccentric to translate the piston block and the cutter head in the reciprocal motion.

DETAILED DISCLOSURE

Exemplary embodiments of systems and methods of tamper-evident food packaging closure are disclosed herein. As described above, it is desirable for a restaurant to have improved solutions for ensuring that an order, once packaged, remains closed and provides an indication that the package food order has not been tampered with or adulterated. By providing a food packaging binding system that reliably and repeatably produces one or more binding perforations through the package, the package can be secured after it is filled with a customer's order. Furthermore, the binding perforations provide a tamper-evident closure as the binding perforations may be damaged when separated by someone gaining access to the interior of the packaging or by manual attempts to re-secure the portions of the binding perforations.

Embodiments of tamper-evident binding systems and methods are described herein that use a mechanical connection to retain portions of a package together in a closed configuration. The mechanical connections used and described herein are exemplarily that of a mechanical die that cuts a portion of material and interweaves it with a slot or other opening cut into adjacent pieces of material to interweave the pieces of material binding them together. In exemplary embodiments, a slot and a tongue shape are cut into stacked pieces of paper and a finger bends the tongue shapes through the slots of adjacent pieces of paper. In this way the layers of paper are held together by the paper tongues which have been cut out and pulled through the slots.

A tamper-evident food delivery packaging system provides resistant binding perforations through packaging of prepared food items to resiliently close The embodiment noted above and as described in further detail herein provides an advantage in a food preparation setting as food order packaging can be closed without the use of staples, which may present a food sanitation risk of puncture or cross-contamination of food order items.

Figure 1:
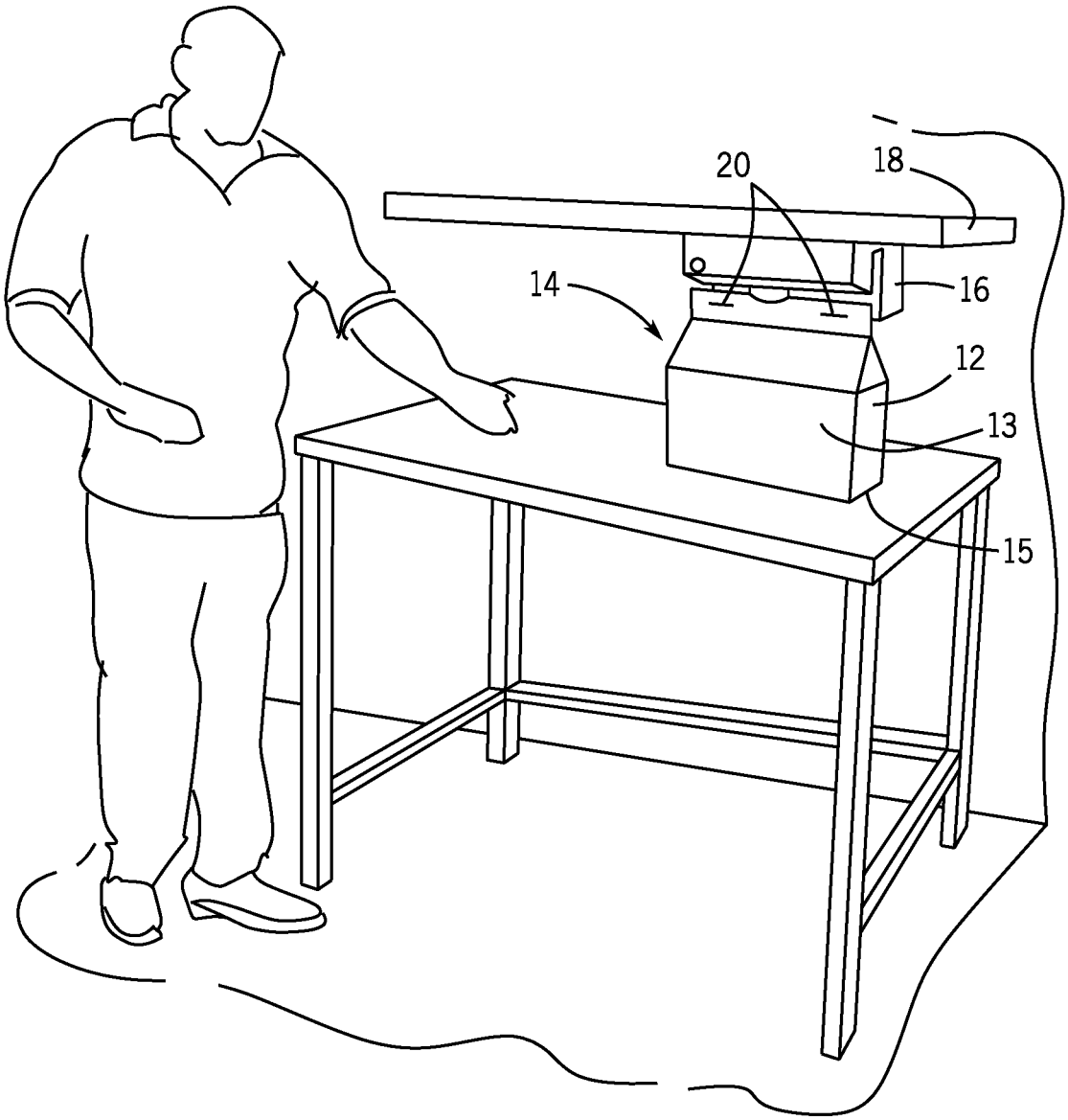
FIG. 1 is an environmental view of an exemplary embodiment of a food delivery packaging system.

FIG. 1 depicts an environmental view of a food delivery packaging system 10. The system 10 uses a food order packaging 12, exemplarily a bag. The packaging 12 may be made of paper, and/or multiple layers or thicknesses of a paper or cardboard. The bag may further comprise a polymer treated paper, a waxed paper, or the like that imparts additional properties to the bag, for example, liquid resistance or insulative properties. In embodiments, mechanical closure of the packaging 12 can further help to maintain the environment within the bag, for example to keep the food product contained therein from the elements, for example rain, or to help to maintain a warm and/or humid environment surrounding the food so as to hold the temperature and palatable condition of the food for a longer duration during delivery. The packaging includes a peripheral wall 13 and a bottom 15. The peripheral wall 13 and the bottom 15 define an open interior of the packaging 12. Opposite the bottom 15 is an open end 14 that forms an opening in the packaging 12. The ends of the peripheral wall 13 at the open end 14 are movable (e.g. flexible, bendable, pliable) towards each other to bring the peripheral walls together at the open end 14 to close the open interior of the packaging 12.

A binding apparatus 16 may exemplarily be a mechanical or electromechanical device that operates to place one or more resistant binding perforations through the peripheral walls 13 of the packaging 12 to maintain closure of the open end 14 of the packaging 12. The binding apparatus 16 may be arranged on a shelf 18 of a food preparation table or station. In other embodiments, the binding apparatus 16 may be mounted to other structures, for example, a table or a wall, while in other embodiments the apparatus may be mounted to a movable arm or tether. In still further embodiments, the binding apparatus 16 may be hand-held and manually operated. In use, the peripheral walls 13 the free, open end of the package 12 are brought together, and optionally may be folded over, to form an initial closure of the open end 14 of the package 12 and this end of the package is inserted into the binding apparatus 16 which punches one or more resistant self-fastening perforations 20 through the peripheral walls 13 of the packaging 12 fastening closed the open end 14 of the packaging 12.

Figure 2:
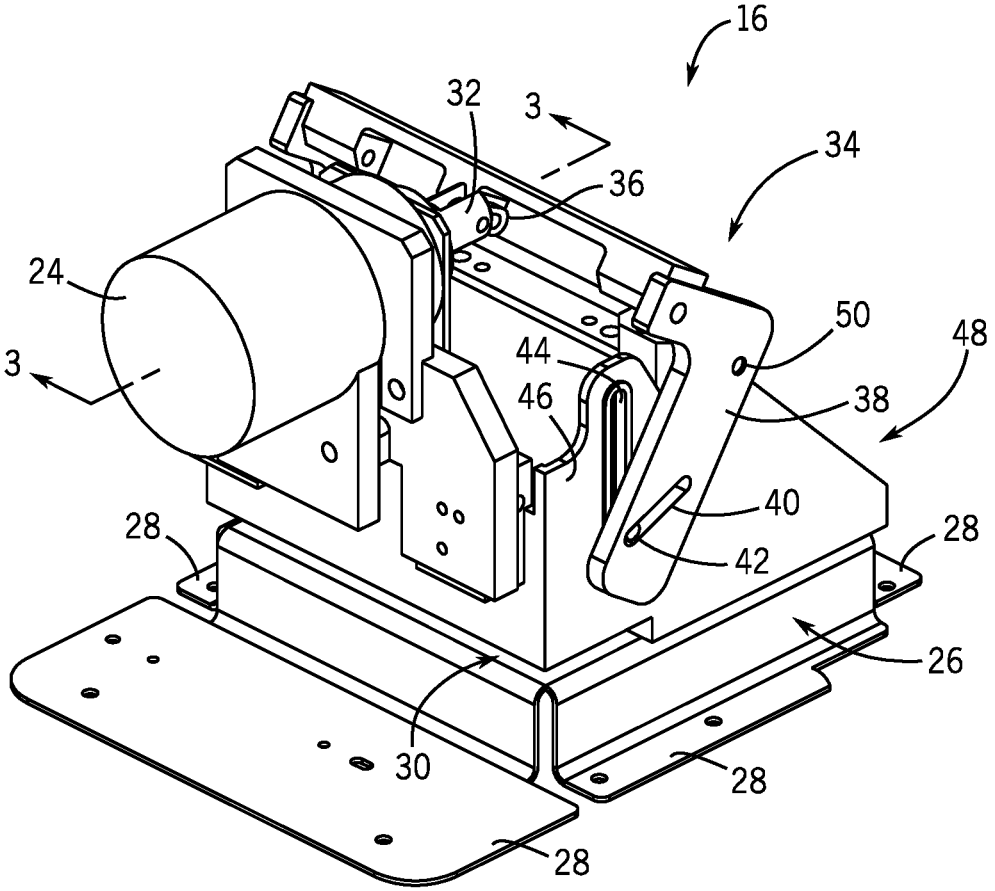
FIG. 2 is a perspective view of an exemplary embodiment of a binding apparatus.
Figure 3:
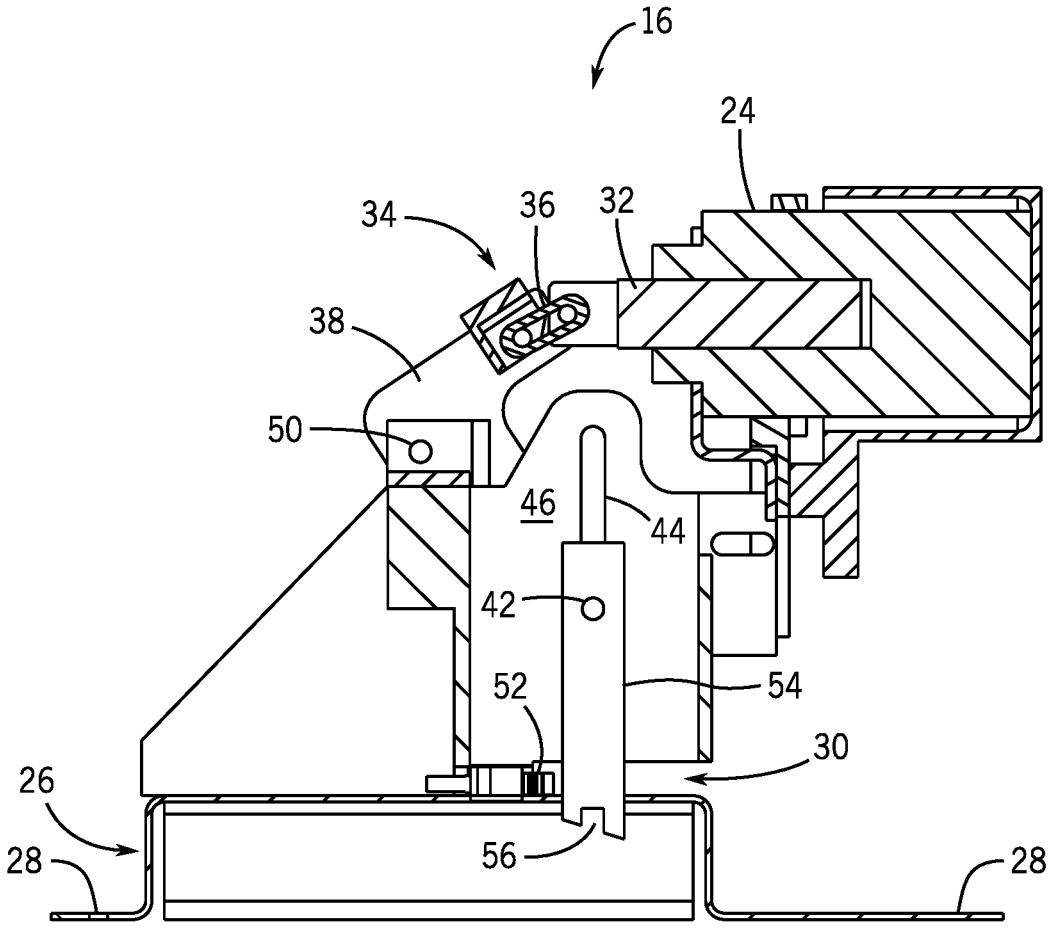
FIG. 3 is a sectional view taken along line 3-3 of FIG. 2.

FIGS. 2 and 3 depict one exemplary embodiment of a binding apparatus 16, the features of which will be described in further detail herein. The binding apparatus 16 may include a cover (not depicted) that protects the mechanical components of the binding apparatus 16 and provides safety by limiting access to the moving and cutting components, the binding apparatus 16 includes an actuator, which may be a solenoid 24 which is electromechanically actuated upon initiation of a switch 52 as will be described in further detail herein. The actuator operates to move the cutting head to create the self-fastening arrangements as described herein.

The binding apparatus 16 includes a chassis 26 which forms a base portion of the binding apparatus 16 as described in further detail herein. The chassis 26 may include one or more mounting flanges 28 which are operable to secure the binding apparatus 10 to a mounting location or apparatus within the food preparation setting. It will be recognized that as alternatives to flanges as shown in FIG. 1 that exemplary embodiments of the chassis 26 may be configured for mounting as in any of the arrangements as exemplarily described above. The binding apparatus 16 further includes a cutter assembly 48. The cutter assembly 48 operates as further described herein to produce self-fastening perforations. A slot 30 extends is into the chassis 26. The slot 30 is exemplarily a space between portions of the cutter assembly 48 and the chassis 26. As described in further detail herein, the open end of the bag is received within the slot 30 where upon actuation of the cutter head 54 forms the self-fastening perforations in the packaging.

The binding apparatus 16 includes a solenoid actuator 32 which upon actuation of the binding apparatus 16 is extended outwards by the solenoid 24 to impart a force on the cutter assembly 48. The cutter assembly 48 is mounted to the chassis 26. The cutter assembly 48 includes a bellcrank 34. The bellcrank 34 is mechanically coupled to the solenoid actuator 22 by a linkage 36. The bellcrank 34 further includes bellcrank arms 38. The bellcrank arms 38 movably engage a cutter shaft 42 of the cutter assembly 48 that extends between the bellcrank arms 38 and the cutter shaft 42 is moveable within a slot 40 in the bellcrank arm 38. The cutter shaft 42 is also moveable within slots 44 in the cutter frame 46. The solenoid 24 is exemplarily mounted to the cutter frame 46.

As the solenoid actuator 32 extends outward, the actuator 32 presses against the bellcrank 34 and the bellcrank 34 pivots about a pivot point 50 between the bellcrank 34 and the cutter frame 46 to raise and/or lower the cutter shaft 42 relative to the chassis 26.

The switch 52 is exemplarily an electromechanical switch. The switch 52 is exemplarily positioned within the slot 30 such that the switch 52 is mechanically actuated by impingement of the free end of the bag against the switch 52. In an exemplary embodiment, this mechanical impingement closes a circuit that results in actuation of the solenoid 24 causing the cutter head to move in the direction of the bag in order to cut the self-fastening perforations. While the switch 52 is depicted as an electromechanical switch, it will be recognized that other forms of switches may be used in embodiments as disclosed herein, such switches may include, but are not limited to a photo interrupter sensor for example that operates in the visible light or IR light spectrum, an inductor a magnetic field sensor whereby changes in an electromagnetic current caused by the positioning of the bag within the slot 30 cause actuation of the solenoid 24.

A person of ordinary skill in the art will recognize other embodiments of sensors as may be used in view of these examples. In still further exemplary embodiments, a button, lever, or another manual switch may be provided wherein a user inserts the free end of the bag into the slot 30 and then manually actuates the associated input to actuate the solenoid 24.

It will be recognized that in embodiments, the communication between the switch 52 and the solenoid 24 may be performed electronically or digitally through implementation that uses analog hardware or a digital controller which interprets a signal from the switch and provides a control signal to the solenoid 24.

FIG. 3 is a sectional view taken along line 3-3 of FIG. 2. FIG. 3 exemplarily depicts the features of as discussed above with respect to the other Figures but also depicts an exemplary embodiment of a cutter head 54 connected to the cutter shaft 42 and translatable with movement of the cutter shaft 42 by the bellcrank 34. The cutter head 54 moves relative to the slot 30 and to an exemplary anvil 56 formed in the chassis 26. In operation, the engagement between the cutter head 54 and the anvil 56 cuts the exemplary tongue and slot features in the free end of the packaging and withdrawal of the cutter head 54 from engagement with the anvil 56 entwines the tongues with the slots of adjacent pieces of packaging material to form the self-fastening perforations which close the packaging.

While the embodiment depicted in FIGS. 2 and 3 uses an electromechanical solenoid to actuate the movement of the cutter head to form the self-fastening perforations through the packaging, it will be recognized that the binding apparatus may also be implemented as a manually actuated device. In such an embodiment, a handle or lever may be used by an operator to impart a manual force instead of operation of the solenoid to impart a force on the bellcrank. The handle or lever may be pressed or squeezed by the hand of the operator, which force is translated through the bellcrank and the cutting assembly to move the cutter head through the packaging as described above.

FIGS. 4-7 depict a further example of a binding apparatus 16 as may be used with the tamper-evident food delivery packaging system. The binding apparatus 16 may operate to perform similar functions as the other examples of binding apparatus as described above to produce a resistant self-fastening perforation through packaging to close an open end of packaging about a customer food order. It will be recognized that further embodiments within the scope of the present disclosure may combine features as shown and described herein with respect to FIGS. 1-7. The binding apparatus 16 includes a housing 62 which encloses the operational components of the binding apparatus contained therein. An anvil arm 64 extends through the housing 62 and extends adjacent and parallel along a lengthwise dimension of the binding apparatus 16. A flipper plate 66, as will be described in further detail herein, extends through the housing 62 and is arranged parallel to and spaced apart from the anvil arm 64. A space 68 is therefore defined between the anvil arm 64 and the flipper plate 66. The space 68 is dimensioned to accommodate the peripheral wall of the packaging (not depicted) to be closed by the binding apparatus. A button 70 is formed in the anvil arm 64 and in an exemplary embodiment, the button 70 is a user input device and a user actuation of the button 70 provides an input signal, the receipt of which causes the binding apparatus 16 to operate form self-fastening perforation through packaging arranged in the space 68 between the anvil arm 64 and the flipper plate 66.

Figure 4:
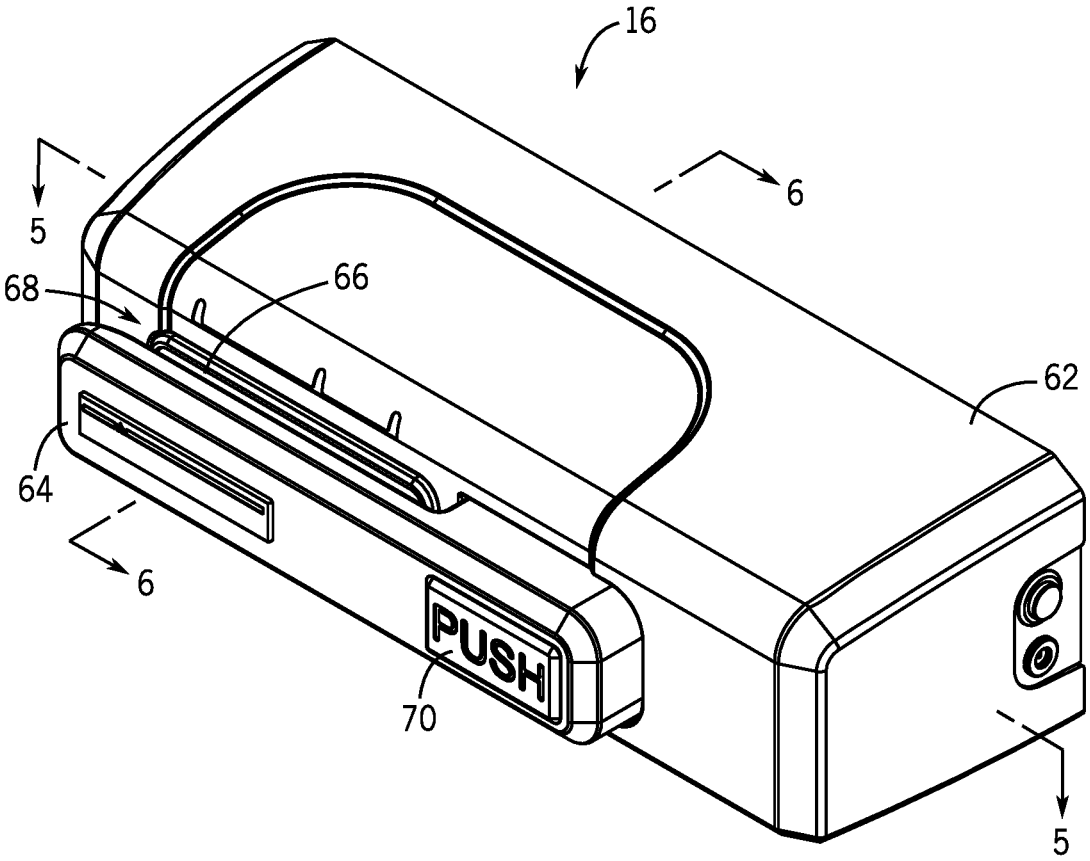
FIG. 4 depicts an exemplary embodiment of a binding apparatus.
Figure 5:
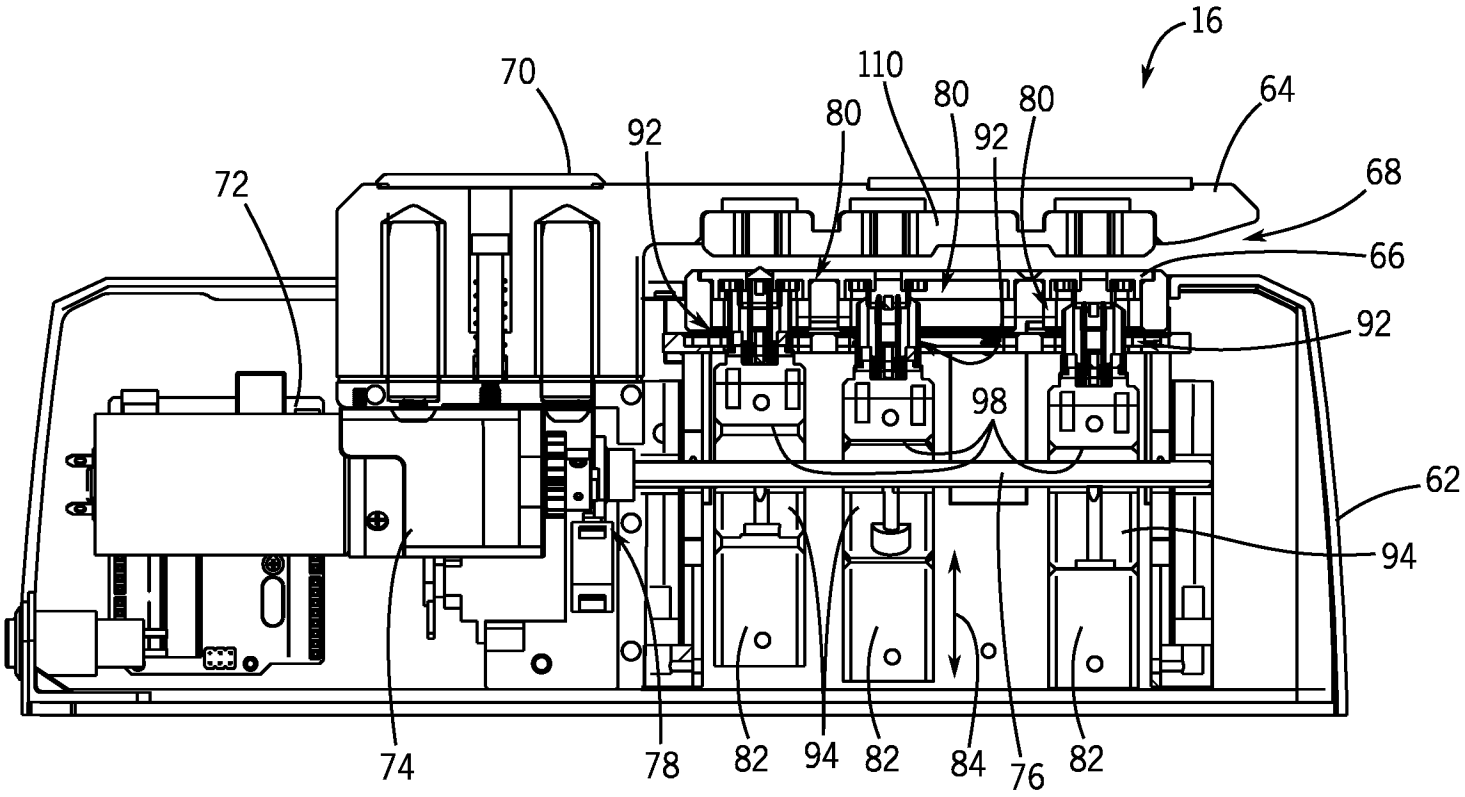
FIG. 5 is a sectional view taken along line 5-5 of FIG. 4.

FIG. 5 is a sectional view of the binding apparatus taken along line 5-5 of FIG. 4. The sectional view of FIG. 5 provides a view interior of the housing 62. The binding apparatus 16 includes a controller 72 which may be a microprocessor, microcontroller, or another control circuit as may be recognized by a person of ordinary skill in the art. The controller 72 may be programmed with computer readable code in the form of software or firmware that upon execution of the code by the controller 72, causes the controller 72 to operate the components of the binding apparatus 16, particularly the motor 74 to operate in the manner as described herein.

The motor 74 is, for example, a servomotor or stepper motor that is operated in response to a control signal produced by the controller 72, The motor 74 operates to rotate a drive shaft 76. The controller 72 provides control signal to the motor 74, for example, in response to the receipt of an input signal, caused by actuation of the button 70, by the controller 72. The motor 74 operates in response to the control signal from the controller 72 to rotate the drive shaft 76 through a predetermined amount of rotation. In an exemplary embodiments this may be one full revolution, a half revolution, or two or more revolutions. It will be recognized that in an embodiment, there may be drive gears 78 arranged between the motor 74 and the drive shaft 76 and not therefore multiple revolutions of the motor 74 may be required to achieve a single revolution of the drive shaft 76.

Figure 6:
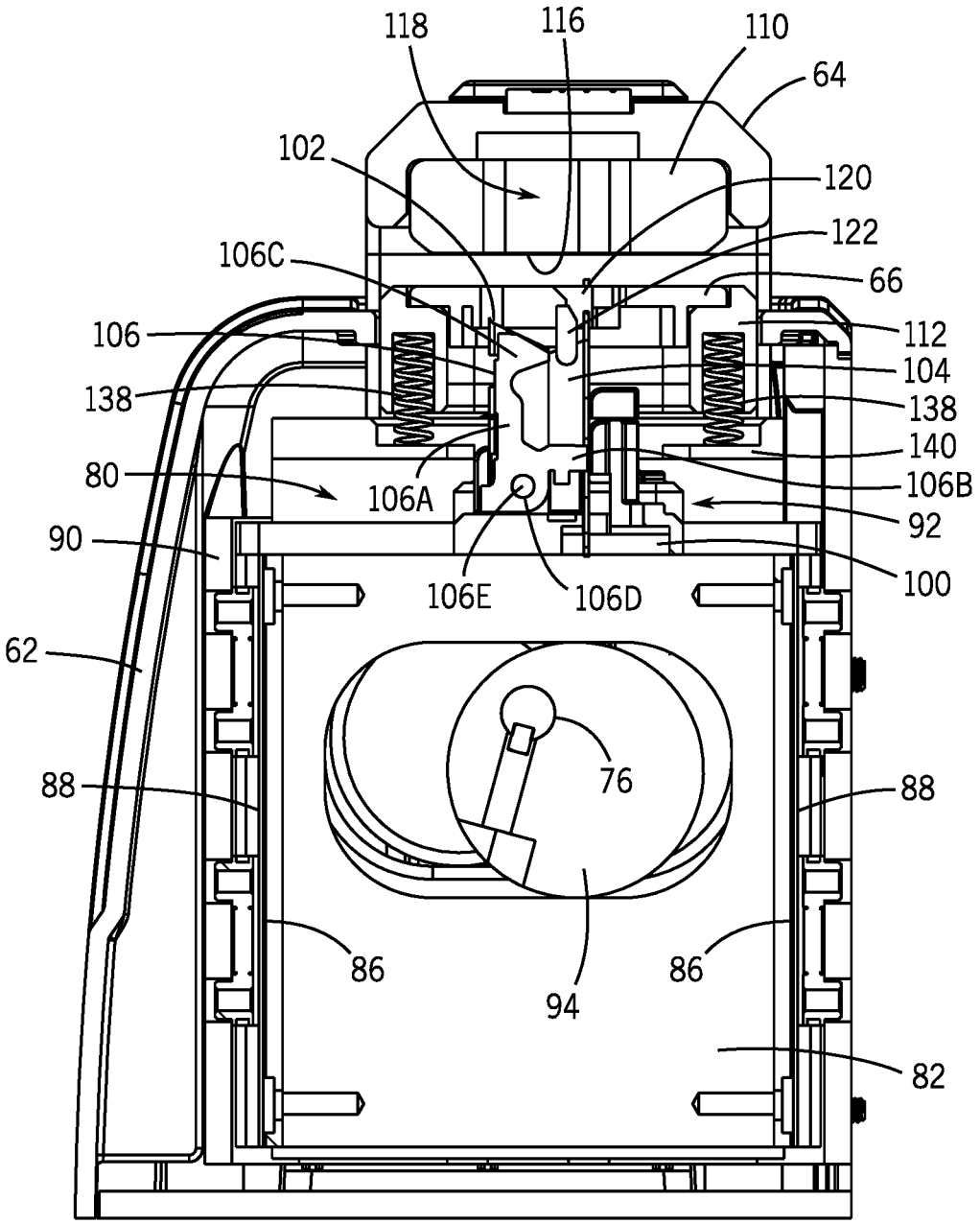
FIG. 6 is a sectional view taken along line 6-6 of FIG. 4.

The embodiment of the binding apparatus 16 depicted in FIGS. 4-6 includes three cutting assemblies 80. However, it will be recognized that other binding apparatus embodiments may include one cutting assembly, two cutting assemblies, or more than three cutting assemblies and that specific apparatus embodiments may be configured with any number of cutting assemblies 80 as needed for the particular use setting.

While a single cutting assembly 80 will be described herein, it will be recognized that similar features apply across each of the cutting assemblies 80. FIG. 6 is a sectional view of the binding apparatus 16 as taken along line 6-6 of FIG. 4 and further depicts features of the cutting assembly 80 as well as the binding apparatus 16.

Each cutting assembly 80 includes a piston block 82 that reciprocates in the direction of reference arrow 84. The piston block 82 is elongated in the dimension in which the piston block 82 reciprocates and has a widened dimension that is perpendicular to the drive shaft 76 as seen in FIG. 6 and a narrow dimension as seen in FIG. 5. Glide bars 86 extend along the narrow dimension of the piston block 82. The glide bars 86 slidingly engage with glide rails 88 that are mounted to the housing 62 or to an internal support plate 90 within the housing 62. It will be recognized that the glide bars 86 and the glide rails 88 may be reversed and positioned on the opposite structure or that other features that facilitate sliding engagement may be used between these structures to maintain the reciprocal movement of the piston block 82 within a predefined plane.

A cutter head 92, as will be explained in further detail herein, is secured to the piston block 82 such that the cutting assembly 80 comprising the piston block 82 and the cutter head 92 is jointly movable. A secure connection, for example by a fastener connection, welded connection, or unitary construction between at least a portion of the cutter head 92 and the piston block 82 secures these components together.

An eccentric 94 is secured to the drive shaft 76. The eccentric 94 is positioned within an opening 96 defined within the piston block 82. The eccentric 94 movably engages a contact surface 98 of the piston block 82 that defines the opening 96. The eccentric 94 is secured to the drive shaft 76 at a position offset from a center point or rotational axis of the eccentric 94 and thus rotation of the eccentric 94 about the drive shaft 76 provides a cam action against the contact surface 98 to move the cutting assembly 80 in the reciprocating motion of reference arrow 84. It will be recognized that other embodiments of eccentrics and eccentric cams may be used while remaining within the scope of the present disclosure. As seen in FIG. 5, the eccentric 94 may be positioned at different relative orientations about the drive shaft 76 between cutting assemblies in the embodiment of binding apparatus that include multiple cutting assemblies 80. In such an arrangement each cutting assembly will be at a different position in the reciprocal movement at any point in time operated by the motor.

Figure 7:
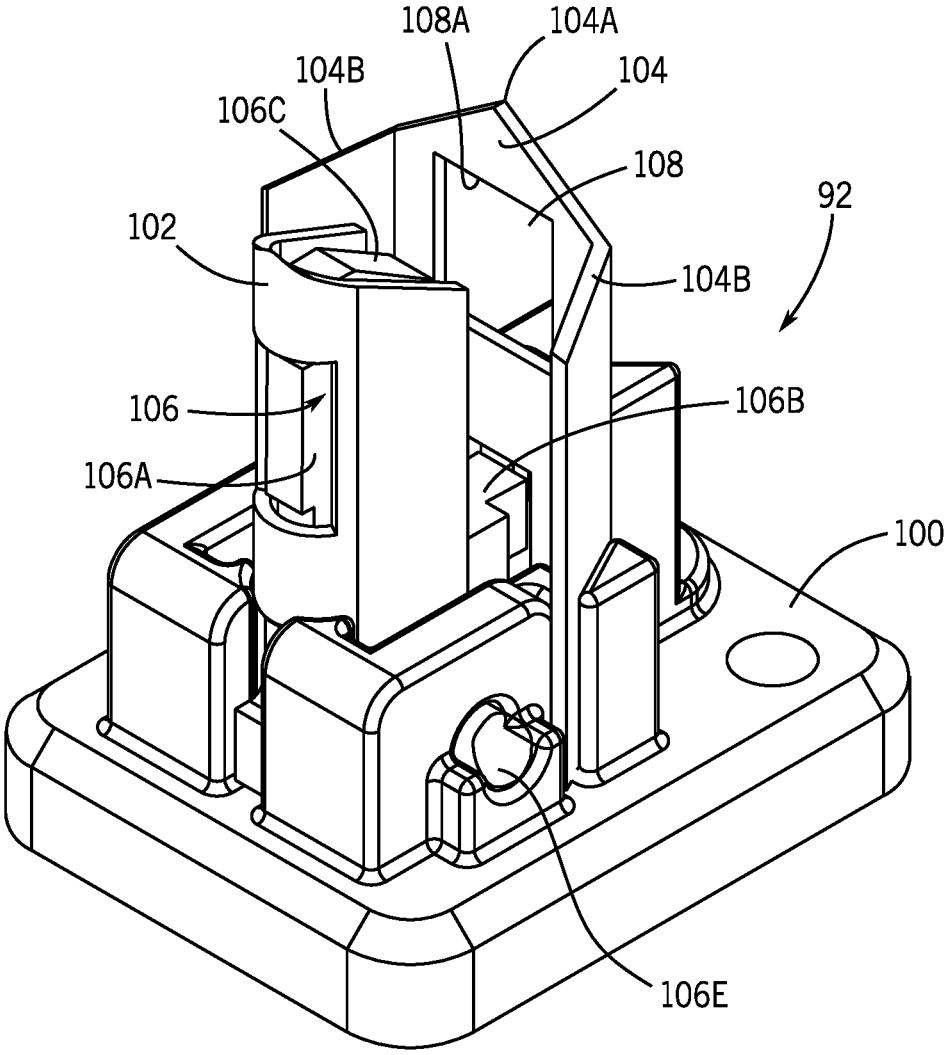
FIG. 7 depicts an exemplary embodiment of a cutter head.

FIG. 7 depicts an exemplary embodiment of a cutter head 92 as is seen in FIGS. 5 and 6. The cutter head 92 includes a blade mount 100 which securely holds the profile blade 102 and the slot blade 104 in a fixed relationship and further secures the cutter head 92 to the piston block 82. The slot blade 104 exemplarily includes a tip 104*a* and angled side projections. The tip 104*a* of the slot blade 104 cuts the slot through the layers of packaging as described in further detail herein while the slot portions provided by the side projections 104*b* provide an additional degree of freedom for insertion of the tongues cut from the packaging by the profile blade 102 through the slot cut through the packaging by the slot blade 104 without further tearing of the packaging material, which would weaken the securement provided by the self-fastening perforation. The profile blade 102 is exemplarily a "U" shape and cuts a similarly shaped tongue through the packaging material. However, it will be recognized that other shapes of tongues may be cut and used and a corresponding shape of the profile blade used in the cutter head 92, these may include but are not limited to rectangular or cruciform tongues cut by correspondingly shaped profile blades.

The cutter head 92 further includes a pusher 106. As seen in FIG. 6, the pusher 106 is generally "L" shaped with a body 106*a* and an arm 106*b* generally perpendicular to the body. A finger 106*c* that extends from an end of the body 106*a* opposite that of the arm 106*b*. The pusher 106 further includes a pivot 106*d* which receives a pivot pin 106*e* therethrough. The pusher 106 is rotatable on the pivot 106*d* about the pin 106*e* through a limited range of motion in order to push the tongues cut through the packaging by the profile blade 102 through the slot in the packaging cut by the slot blade 104. An aperture 108 is provided through the slot blade 104 and the finger 106*c*, as well as the tongues cut from the packaging material, are pushed through the aperture 108 to intertwine the tongues with the slot.

Figure 8:
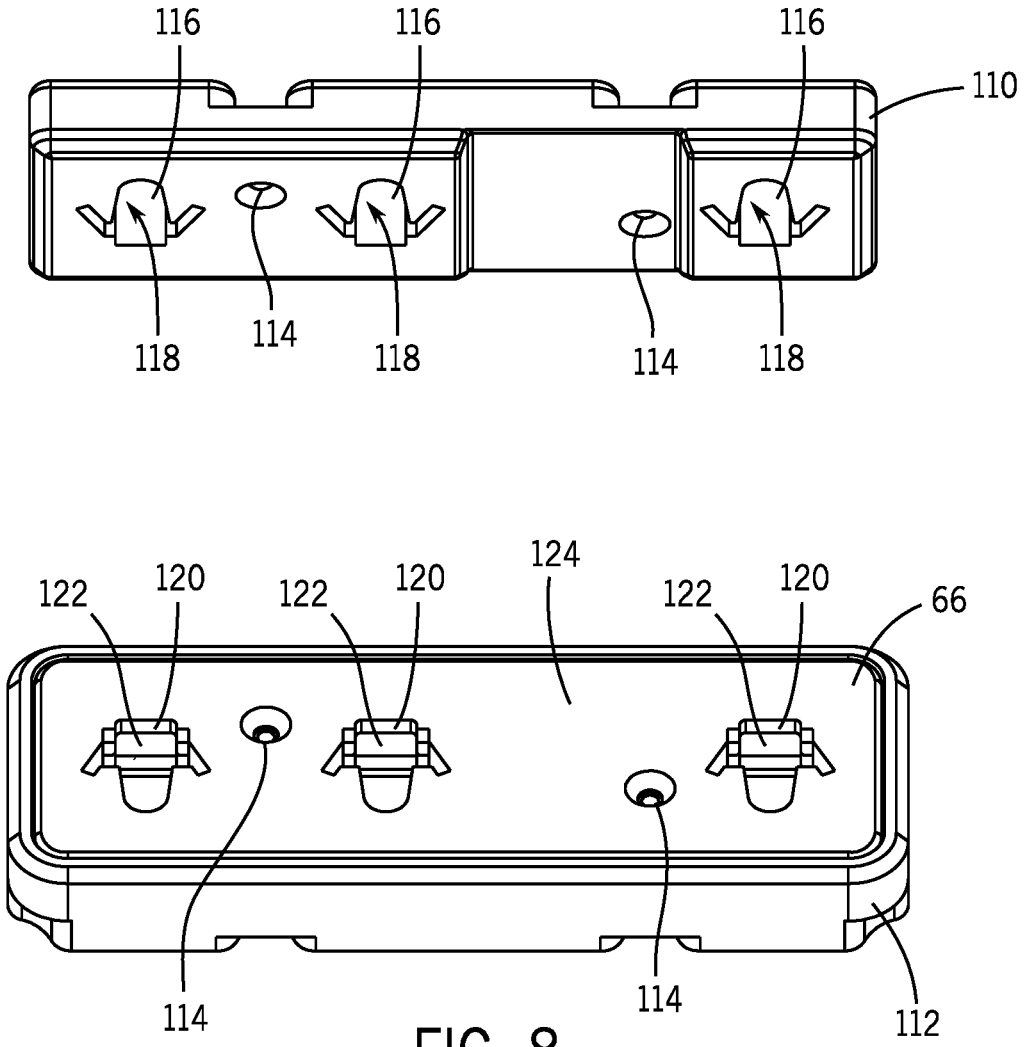
FIG. 8 is a detailed and exploded view of exemplary embodiments of an anvil and a flipper plate.

FIG. 8 is an isolated and exploded view of the anvil 110, flipper plate 66 and the flipper support 112 as seen in FIGS. 5 and 6, the anvil 110 is fastened within the anvil arm 64. Similarly, the anvil 110 may be secured to anvil arm 64 with fasteners extending through fastener holes 114. The flipper plate 66 is exemplarily similarly secured to the flipper support 112 with fasteners through the holes 114. The anvil 110 includes an anvil aperture 116 which is dimensioned to be commensurate in shape with the combined profile of the slot blade 104 and the profile blade 102 such that a portion of the slot blade 104 and the profile blade 102 may be extended therethrough. It will be noted that the anvil 110 includes a thickness in the dimension having the direction of reference arrow 84 that recesses 118 are formed in the anvil 110 to receive a portion of the slot blade 104 and the profile blade 102 therein.

The flipper plate 66 include flipper apertures 120. The apertures 120 through the flipper plate 66 are similarly shaped as anvil apertures 116 such as to receive translation of at least a portion of the profile blade 102 and the slot blade 104 there through as the cutting assemblies 80 reciprocate in the direction of reference arrow 84. The flipper plate 66 further includes a flipper bar 122 which extends across the flipper aperture and, as best seen in FIG. 6 extend beyond the flipper plate 66 in a direction away from the exterior surface of the flipper plate 124.

As the cutting assembly 80 is translated, the cutter head 92 extends into and through the flipper aperture 120 as the profile blade 102 and the slot blade 104 begin to extend out of the flipper apertures 120, extending proud of the exterior surface of the flipper plate 124. The flipper bar 122 engages with the arm 106*b* of the pusher 106. As the cutter head 92 continues to translate in the same direction. This places a force against the arm 106*b* and the pusher 106 rotates about the pivot 106*d* about the pin 106*e*. Rotation of the pusher 106 advances the finger 106*c* forward, the finger 106*c* engaging the tongue, newly cut by the profile blade 102, and pushes the tongue through the slot cut by the slot blade 104. The tongue and the finger 106*c* partially extend through the aperture 108 in the slot blade 104.

As the motor 74 continues to advance and the eccentric 94 rotate within the piston block 82, the cutting assembly 80 begins to retract. The cutter head 92 retracts away from the flipper bar 122 and the pusher 106 rotates back into its original position. As the cutting assembly 80 further retracts, the top edge 108*a* of the aperture 108 through the slot blade 104 engages the tongue and pulls the tongue through the newly cut slot as the slot blade continues to retract. In this manner the resistant self-fastening perforation through the peripheral walls of a packaging is formed.

Figure 9:
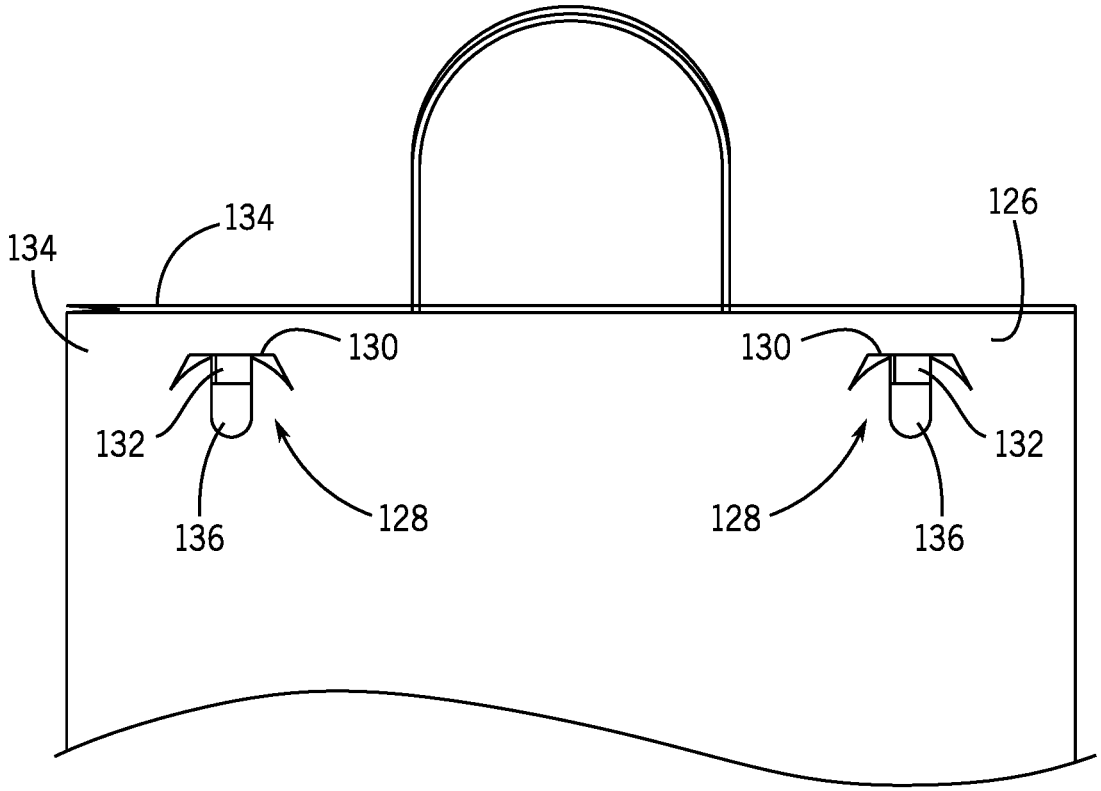
FIG. 9 depicts an exemplary embodiment of packaging with tamper-evident closure by resistant self-fastening perforations.

FIG. 9 depicts an exemplary embodiment of a packaging 126 exemplarily in the form of a bag in which a customer order of food may be assembled and placed. The packaging 126 is closed with two resistant self-fastening perforations 128 which provide a tamper-evident closure of the packaging 126. The resistant self-fastening perforations 128 include the slot 130 cut by the slot blade 104 as described herein and the tongue 132 which has been folded over by the pusher 106 as previously described and inserted through the slot 130 by the slot blade 104. It will be recognized that the tongues 132 are formed by the material of both peripheral walls 134 of the packaging 126. The tongues 132 extend through combined slots 130 cut both of the peripheral walls 134. Cutting of the tongues 132 by the profile blade 102 leaves behind a tongue hole 136 that extend through the packaging 126 as the tongues 132 are formed from the material of both of the peripheral walls 134.

As previously described, the flipper plate 66 is secured to a flipper support 122. As depicted in FIG. 6, resistant springs 138 extend between a top support 140 of the binding apparatus 16 and a lower side of the flipper support 112. The springs 138 provide a damping effect on the compression of the packaging material and also in the event any overrun by the cutting assembly 80 such that the cutter head 92 is able to move all the way to the outermost extent of extension cycle to maximize cutting of the tongue and the slot and movement of the tongue through the aperture 108.

Figure 10C:
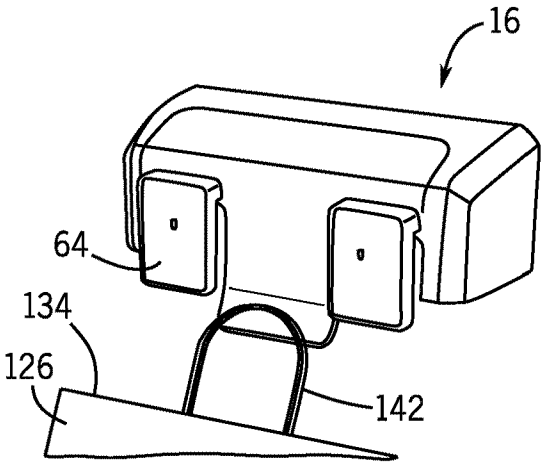
FIGS. 10A-F depict further examples of the binding apparatus.
Figure 10F:
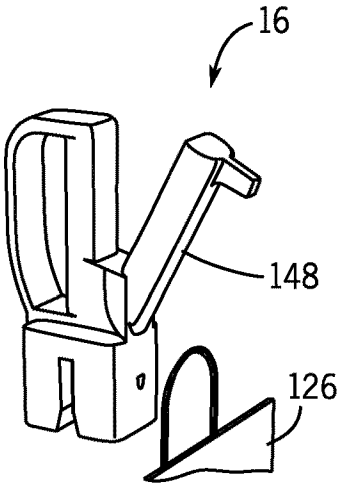
Figure 10B:
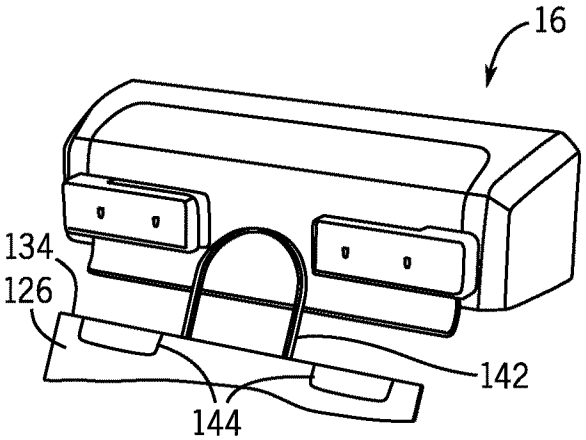
Figure 10E:
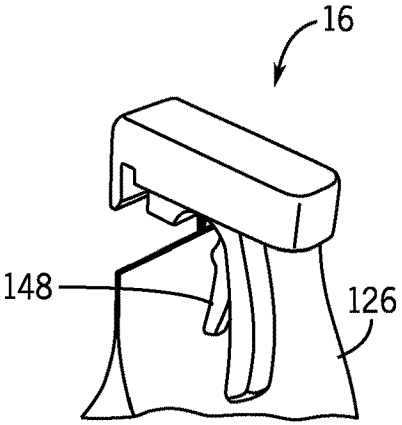
Figure 10A:
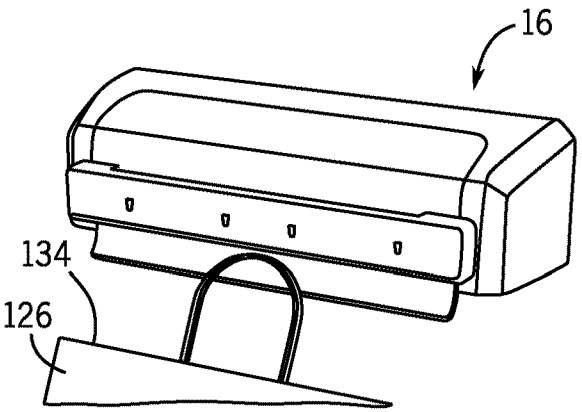

FIGS. 10A-10F depict exemplary embodiments of different form factors of binding apparatus 16 as have been described herein. It will be recognized that some or all of the features as described above in embodiments of the binding apparatus 16 may be incorporated into the embodiments depicted in FIGS. 10A-10F, including any modifications as may be required to achieve the functional forms as depicted and described herein with respect to these examples, and that such embodiments and modifications are within the scope of the present disclosure. FIG. 10A depicts an exemplary embodiment of an electromechanical binding apparatus 16 in which the packaging 126 is provided with resistant self-fastening perforations across the entire length of the packaging in one process of the binding apparatus 16. The binding apparatus 16 depicted in FIG. 10B is similar although a space is provided between two opposingly oriented anvil arms 64 such as to accommodate a handle 142 of the packaging 126. FIG. 10B also depicts a further exemplary embodiment of a packaging 126 in which flaps 144 extend from one of the peripheral walls 134 and are folded over upon closure of the peripheral walls 134. The resistant self-fastening perforations are provided through this flap 144 as well.

The binding apparatus 16 depicted in FIG. 10C is a similar embodiment to those as depicted in FIGS. 10A and 10B, with the exception of the anvil arms 64 being oriented normal to the orientation of the anvil arms 64 in the other embodiment such that the handle 142 of the packaging 126 is accommodated there between and the operator is given guidance as to proper positioning of the packaging 126 relative to the binding apparatus 16 because the ends of the peripheral walls 134 engage a back end of the anvil arm 64.

It will be recognized that while the examples provided in FIGS. 10A-10C are exemplarily depicted as electromechanical embodiments, that through the disclosure provided herein, such binding apparatus forms may be implemented as manually actuated binding apparatus. Incorporation of a level or handle and levers, linkages, or mechanical components as described in the present disclosure may provide the mechanical advantage for a manual user application of force to the binding apparatus can cut one or more resistant self-fastening perforations through a packaging.

Figure 10D:
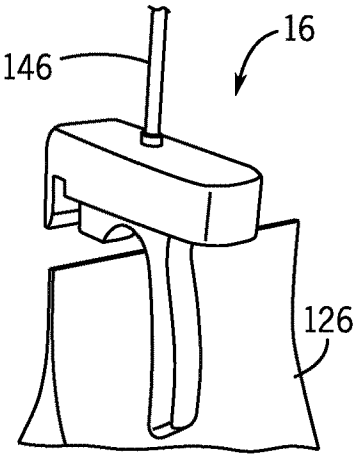

FIG. 10D-10F depict still further exemplary embodiments of binding apparatus 16. While the binding apparatus 16 as depicted in FIGS. 10A-10C are exemplarily configured for mounting on a structure, for example, a shelf, table or wall the embodiments depicted in FIGS. 10D-10F are configured for hand-held use. An electromechanical embodiment as depicted in FIG. 10D includes a flexible tether 146 which both helps to define a location within which an operator can expect to find the binding apparatus 16, as well as to provide the conveyance of power thereto. The binding apparatus 16 may include a trigger or a button feature that is actuated by the operator in order to initiate operation of the binding apparatus 16 to place a resistant self-fastening perforation into the packaging 126 at the position defined by the operator's location of the binding apparatus 16 relative to the packaging 126. FIGS. 10E and 10F depict manually actuated embodiments of the binding apparatus 16. As described above, exemplary embodiments of binding apparatus 16 may be manually actuated and force generated by the hand of the operator against a lever 148 manually moves the cutting assembly through the packaging 126 in order to create the resistant self-fastening perforations 128 through the packaging 126.

It will be recognized that still further embodiments of the binding apparatus and tamper-evident food delivery packaging systems as disclosed herein may be formed through combinations of features described above with respect to one or more of the figures above. Such further combinations may include more or fewer of the specific features as shown individually in any of the figures and are within the scope of the present disclosure.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A tamper-evident food delivery packaging system, the system comprising:

packaging configured to receive a food order therein, the packaging comprising an open interior defined at least in part by a peripheral wall and a bottom end of the packaging, the packaging comprising an opening at an open end opposite the closed end wherein ends of the peripheral wall about the opening are movable such as to bring the ends of the peripheral wall together to close the open interior of the packaging; and a tamper-evident binding apparatus comprising:

an anvil;

a profile blade having a concave perimeter;

a slot blade having a concave perimeter, the slot blade being wider across the concave perimeter of the slot blade than across the concave perimeter of the profile blade;

a blade mount to which the profile blade and the slot blades are rigidly secured to form a cutter head, wherein the concave perimeter of the profile blade opens towards the concave perimeter of the slot blade;

a pusher pivotably connected to the blade mount at a position intermediate the profile blade and the slot blade, and configured to pivot about a pivot point; and a flipper plate disposed intermediate the cutter head and the anvil, the flipper plate comprising an opening and a flipper bar extending across the opening;

wherein the cutter head is movable in a reciprocal motion relative to the anvil, and in the reciprocal motion at least a portion of the cutter head extends through the opening through the flipper plate and the flipper bar engages the pusher to pivot the pusher about the pivot point;

wherein when the packaging is positioned between the anvil and the flipper plate, the reciprocal motion of the cutter head cuts a resistant self-fastening perforation through the ends of the peripheral walls to resiliently close the opening of the packaging.

2. The system of claim 1, wherein the profile blade operates to cut a tongue from the peripheral walls and the slot blade operates to cut a slot through the peripheral walls, and pivoting of the pusher about the pivot point engages the tongue and moves the tongue relative to the slot to form the resistant self-fastening perforation.

3. The system of claim 2, wherein the slot blade comprises an aperture defined through the slot blade, and wherein a finger of the pusher extends through the aperture of the slot blade when the pusher pivots about the pivot point, wherein the finger pushes the tongue through the aperture.

4. The system of claim 3, wherein upon retraction of the cutter head in the reciprocal motion, a top edge of the aperture engages the tongue and pulls the tongue through the slot to form the resistant self-fastening perforation.

5. The apparatus of claim 4, further comprising a motor connected to a drive shaft, wherein operation of the motor rotates the drive shaft to cause the reciprocal motion of the cutter head.

6. The system of claim 5, further comprising an eccentric secured to the drive shaft, wherein the eccentric engages a cutting assembly comprising the cutter head to transfer rotational movement of the drive shaft to the reciprocal movement of the cutter head.

7. The system of claim 6, wherein the cutting assembly further comprises a piston block, the cutter head secured to the piston block, the piston block further comprising an opening therethrough defined by a contact surface, wherein the eccentric engages the contact surface of the piston block to transfer rotation of the drive shaft to reciprocal motion of the cutting assembly.

8. The system of claim 1, further comprising an anvil arm comprising the anvil and the anvil arm defines an open interior configured to receive at least a portion of the profile blade and the slot blade and the anvil comprises an opening with a perimeter that follows a perimeter of the profile blade and the slot blade.

9. A temporary tamper-evident binding apparatus for closing food packaging, the apparatus comprising:

an anvil;

a profile blade having a concave perimeter;

a slot blade having a concave perimeter, the slot blade being wider across the concave perimeter of the slot blade than across the concave perimeter of the profile blade;

a blade mount to which the profile blade and the slot blades are rigidly secured to form a cutter head, wherein the concave perimeter of the profile blade opens towards the concave perimeter of the slot blade;

a pusher pivotably connected to the blade mount at a position intermediate the profile blade and the slot blade, and configured to pivot about a pivot point; and a flipper plate disposed intermediate the cutter head and the anvil, the flipper plate comprising an opening and a flipper bar extending across the opening; wherein the cutter head is movable in a reciprocal motion relative to the anvil, and in the reciprocal motion at least a portion of the cutter head extends through the opening through the flipper plate and the flipper bar engages the pusher to pivot the pusher about the pivot point.

10. The apparatus of claim 9, wherein the slot blade comprises an aperture defined through the slot blade, and wherein a finger of the pusher extends through the aperture of the slot blade when the pusher pivots about the pivot point.

11. The apparatus of claim 10, wherein the anvil comprises an opening with a perimeter that follows a perimeter of the profile blade and the slot blade.

12. The apparatus of claim 11, further comprising an anvil arm comprising the anvil and the anvil arm defines an open interior configured to receive at least a portion of the profile blade and the slot blade.

13. The apparatus of claim 12, wherein the opening through the flipper plate has a perimeter that follows the perimeter of the profile blade and the slot blade.

14. The apparatus of claim 13, further comprising a motor connected to a drive shaft, wherein operation of the motor rotates the drive shaft to cause the reciprocal motion of the cutter head.

15. The apparatus of claim 14, further comprising an eccentric secured to the drive shaft, wherein the eccentric engages a cutting assembly comprising the cutter head to transfer rotational movement of the drive shaft to the reciprocal movement of the cutter head.

16. The apparatus of claim 15, wherein the cutting assembly further comprises a piston block, the cutter head secured to the piston block, the piston block further comprising an opening therethrough defined by a contact surface, wherein the eccentric engages the contact surface of the piston block to transfer rotation of the drive shaft to reciprocal motion of the cutting assembly.

17. The apparatus of claim 16, wherein the piston block comprises an elongated dimension and a set of glide bars and glide rails engage to guide translation of the cutting assembly in the reciprocal motion.

18. A method of providing food in tamper-evident packaging, the method comprising:

providing a packaging configured to receive a food order therein, the packaging comprising an open interior defined at least in part by a peripheral wall and a bottom end of the packaging, the packaging comprising an opening at an open end opposite the closed end wherein ends of the peripheral wall about the opening are movable such as to bring the ends of the peripheral wall together to close the open interior of the packaging;

positioning the peripheral walls of the packaging within a slot between a flipper plate and an anvil of a tamper-evident binding apparatus, wherein the tamper-evident binding apparatus further comprises:

a profile blade having a concave perimeter;

a slot blade having a concave perimeter, the slot blade being wider across the concave perimeter of the slot blade than across the concave perimeter of the profile blade;

a blade mount to which the profile blade and the slot blades are rigidly secured to form a cutter head, wherein the concave perimeter of the profile blade opens towards the concave perimeter of the slot blade;

a pusher pivotably connected to the blade mount at a position intermediate the profile blade and the slot blade, and configured to pivot about a pivot point; and wherein the flipper plate comprises an opening and a flipper bar extending across the opening and the cutter head is movable in a reciprocal motion relative to the anvil, and in the reciprocal motion at least a portion of the cutter head extends through the opening through the flipper plate and the flipper bar engages the pusher to pivot the pusher about the pivot point;

moving the cutter head in a reciprocal motion relative to the peripheral walls;

cutting a tongue from the peripheral walls with the profile blade; cutting a slot through the peripheral walls with the slot bade; and rotating the pusher about the pivot point to engage the tongue and move the tongue relative to the slot to form the resistant self-fastening perforation.

19. The method of claim 18, wherein the slot blade comprises an aperture defined through the slot blade, and further comprising:

pushing the tongue through the aperture with a finger of the pusher as the pusher rotates about the pivot point; and upon retracting the cutter head in the reciprocal motion, engaging the tongue with a top edge of the aperture pulling the tongue through the slot to form the resistant self-fastening perforation.

20. The method of claim 19, wherein the binding apparatus comprises a motor connected to a drive shaft to which an eccentric is secured and the cutter head is secured to a piston block, the piston block having an opening defined by a contact surface, the method further comprising rotating the eccentric with the motor and drive shaft and engaging the contact surface with the eccentric to translate the piston block and the cutter head in the reciprocal motion.

* * * * *